US007241711B2

(12) United States Patent
Takai et al.

(10) Patent No.: US 7,241,711 B2
(45) Date of Patent: Jul. 10, 2007

(54) WATER-DISINTEGRATABLE SHEET AND MANUFACTURING METHOD THEREOF

(75) Inventors: Hisashi Takai, Kagawa (JP); Kazuya Okada, Kagawa (JP); Takayoshi Konishi, Kagawa (JP)

(73) Assignee: Uni Charm Corporation, Ehime (JP)

( * ) Notice: Subject to any disclaimer, the term of this patent is extended or adjusted under 35 U.S.C. 154(b) by 108 days.

(21) Appl. No.: 10/266,445

(22) Filed: Oct. 8, 2002

(65) Prior Publication Data

US 2003/0100240 A1 May 29, 2003

(30) Foreign Application Priority Data

Oct. 15, 2001 (JP) ..... 2001-316702

(51) Int. Cl.
*D04H 1/00* (2006.01)
*B32B 27/04* (2006.01)
*B27N 1/00* (2006.01)

(52) U.S. Cl. ..... 442/414; 428/292.1; 428/300.4; 428/332; 162/91; 162/98; 162/147; 162/148

(58) Field of Classification Search ..... 442/408, 442/414; 428/300.4, 292.1, 311.11, 311.31, 428/332; 162/115, 91, 98, 97, 99, 147, 148
See application file for complete search history.

(56) References Cited

U.S. PATENT DOCUMENTS 5,151,320 A 9/1992 Homonoff et al.
5,620,694 A 4/1997 Girardot
5,958,186 A * 9/1999 Holm et al. ..... 162/115
6,132,557 A * 10/2000 Takeuchi et al. ..... 162/141
6,258,210 B1 7/2001 Takeuchi et al.
6,642,428 B1 * 11/2003 Kurata et al. ..... 604/364
2001/0023160 A1 9/2001 Yamada et al.
2002/0013559 A1 * 1/2002 Shimizu ..... 604/364
2003/0100240 A1 * 5/2003 Takai et al. ..... 442/408

FOREIGN PATENT DOCUMENTS

EP 0303528 2/1989
EP 1 084 689 * 3/2001
EP 1091042 4/2001
JP 09-228214 9/1997
WO 98/31626 7/1998

OTHER PUBLICATIONS

Patent Abstracts of Japan, "Water Disintegrable Fiber Sheet Comprising Fibrillated Rayon", JP 2001-172850, Uni Charm Corporation, Jun. 26, 2001.

* cited by examiner

*Primary Examiner*—Lynda Salvatore
(74) *Attorney, Agent, or Firm*—Darby & Darby

(57) ABSTRACT

Disclosed is a water disintegratable sheet of which fibers are hydroentangled about each other. The water disintegratable sheet includes: at least one kind of primary fibers having a fiber length of at most 10 millimeter; and bast/leaf fibers having a Canadian Standard freeness value of at most 600 milliliter and a fiber length of at most 10 millimeter.

8 Claims, 3 Drawing Sheets

WATER-DISINTEGRATABLE SHEET AND MANUFACTURING METHOD THEREOF

INCORPORATION BY REFERENCE

The present application claims priority under 35 U.S.C. §119 to Japanese Patent Application No. 2001-316702 filed on Oct. 15, 2001, the entire contents of which being hereby incorporated herein by reference.

BACKGROUND OF THE INVENTION

1. Field of the Invention

The present invention relates to a water disintegratable sheet of which fibers can be dispersed in a large amount of water, more particularly, relates to a water disintegratable sheet which can offer a good balance of strength and water disintegratability.

2. Description of the Related Art

It is preferred that wet sheets for wiping a discharging part of a human body and wet wipers for cleaning a toilet are disintegratable in water. In absorbent articles such as sanitary napkin, panty liner and disposable diaper, it is also preferred that a topsheet covering a top surface of an absorbent layer and a backsheet covering a bottom surface of the absorbent layer are disintegratable in water. In addition, packaging sheets for packaging such absorbent articles are also preferably disintegratable in water.

If these sheets are disintegratable in water, they can be disposed of in a flush toilet after use. Such water disintegratable sheet disposed of in a flush toilet is immersed in a large amount of water in a flush toilet or a septic tank, and constituent fibers of the water disintegratable sheet are dispersed in water, thereby preventing the sheet from floating and remaining in a septic tank.

In such water disintegratable sheet, dry strength should be excellent as well as wet strength should be increased to some extent. When put in a large amount of water, on the other hand, the constituent fibers should be rapidly dispersed.

Japanese Unexamined Patent Publication No. H9-228214 (1997/228214) discloses a water disintegratable nonwoven fabric, which is produced by blending pulp with regenerated cellulose fibers having a fiber length of 4 to 20 mm, forming a web on a wire belt of a paper machine, and entangling the fibers about each other through a water-jet treatment. In this water disintegratable nonwoven fabric, the wet strength is increased by entangling the long regenerated cellulose fibers about each other through the water-jet treatment, as well as the dry strength is increased by entangling pulp about each other and about the regenerated cellulose fibers. On the other hand, when the sheet formed by entangling the fibers is immersed in a large amount of water, the fiber entanglement is loosened so that the sheet can be disintegrated in water. It is also disclosed that fibrillated pulp may also be used for increasing the strength of the water disintegratable nonwoven fabric.

The water disintegratable nonwoven fabric disclosed in the above-mentioned Publication is intended to obtain the sheet strength and the water disintegratability by entanglement of the regenerated cellulose fibers and pulp. In such fiber entangled nonwoven fabric, however, it is difficult to improve both the sheet strength and the water disintegratability. For example, if long regenerated cellulose fibers having a fiber length of about 20 mm are used, the fibers are excessively entangled through the water-jet treatment, deteriorating the water disintegratability. Conversely, if short regenerated cellulose fibers having a fiber length of about 4 mm are used, the fibers cannot be sufficiently entangled, deteriorating the sheet strength.

The above-mentioned Publication also discloses the use of fibrillated pulp for increasing the strength of the nonwoven fabric. However, pulp is as short as 4 mm or less, and it will be cut into small short pieces when fibrillated by beating. The fibrillated pulp thus cut into small short pieces cannot sufficiently bind the regenerated cellulose fibers and pulp, because it is too small and short.

In addition, since beaten pulp is too small and short, it easily drops out of a fibrous web during the web formation or the water-jet treatment, thereby deteriorating the yield. On the other hand, if the fibrillated pulp thus cut into small short pieces is agglomerated in the fibrous web, the dispersibility of the regenerated cellulose fibers is deteriorated, thereby making it difficult to form a nonwoven fabric in which fibers are uniformly distributed.

SUMMARY OF THE INVENTION

The present invention has been worked out in view of the shortcoming in the prior art set forth above. It is therefore an object of the present invention to provide a relatively bulky and soft water disintegratable sheet having improved wet and dry strengths, and a method of manufacturing the same.

According to a first aspect of the present invention, there is provided a water disintegratable sheet of which fibers are hydroentangled about each other, comprising:

at least one kind of primary fibers having a fiber length of at most 10 millimeter; and bast/leaf fibers having a Canadian Standard freeness value of at most 600 milliliter and a fiber length of at most 10 millimeter.

As set forth above, since the water disintegratable sheet of the present invention is a hydroentangled (spunlaced) nonwoven fabric, the sheet can be provided with an uneven surface to improve bulk and softness. In the present invention, the bast/leaf fibers having a Canadian Standard Freeness value of at most 600 ml and a fiber length of at most 10 mm can achieve a good balance of strength and water disintegratability, in association with the primary fibers having a fiber length of at most 10 mm.

Preferably, the water disintegratable sheet contains 2 to 30% by weight of bast/leaf fibers based on a total fiber weight of the water disintegratable sheet. If the bast/leaf fiber content is less than 2% by weight, the sheet strength may be deteriorated. If the bast/leaf fiber content is more than 30% by weight, the water disintegratability may be deteriorated.

Preferably, the bast/leaf fibers are fibrillated. Since the fibrillated bast/leaf fibers can easily be entangled, the sheet strength can be sufficiently increased even if the bast/leaf fiber content is low.

Preferably, the bast/leaf fibers are leaf fibers. More preferably, used is at least one of abaca and sisal. The leaf fibers, especially abaca and sisal, can easily be fibrillated by beating. In addition, abaca and sisal are hardly cut into small short pieces by beating, and can maintain the fiber strength even after beating.

Preferably, the primary fibers are biodegradable fibers. If so, when the water disintegratable sheet is disposed of in a toilet or the like, the constituent fibers dispersed in water can be biodegraded. Therefore, the functions of a septic tank and a sewage line will not be damaged, and deterioration of environment can be prevented. In this case, the biodegradable fibers are preferably pulp fibers and/or regenerated cellulose fibers.

Preferably, the water disintegratable sheet has a dry strength of at least 5.0 Newton per 25 millimeter width and a wet strength of at least 1.3 Newton per 25 millimeter width. With the dry strength and wet strength being set within the above-mentioned ranges, the water disintegratable sheet hardly breaks during use.

Preferably, the water disintegratable sheet has a basis weight of 30 to 100 g/m$^2$. If the basis weight is less than 30 g/m$^2$, sufficient strength cannot be obtained, resulting in breakage during use. If the basis weight is more than 100 g/m$^2$, on the other hand, the web formation becomes difficult, causing a variation in properties of the resulting water disintegratable sheet.

Preferably, the water disintegratable sheet has a water disintegratability of at most 300 seconds.

According to a second aspect of the present invention, there is provided a method of manufacturing a water disintegratable sheet comprising the steps of:

(a) forming a fibrous web including 98 to 70% by weight of at least one kind of primary fibers having a fiber length of at most 10 millimeter, and 2 to 30% by weight of bast/leaf fibers having a Canadian Standard freeness value of at most 600 milliliter and a fiber length of at most 10 millimeter;

(b) entangling the fibers about each other by subjecting the fibrous web to a water-jet treatment; and (c) drying the entangled fibrous web.

In the step (a), it is preferred that a blend of the primary fibers and the bast/leaf fibers is formed into the fibrous web through a wet-laid process. However, it is also possible to form the fibrous web through a dry-laid process.

In the step (b), it is preferred that the work done by jets of water in one water-jet treatment for one surface of the web is 0.05 to 0.5 KW/m$^2$, and the web is subjected to the water-jet treatment 1 to 6 times. With the work done by jets of water being set within the above-mentioned range, the water disintegratable sheet can achieve a good balance of sheet strength and water disintegratability.

BRIEF DESCRIPTION OF THE DRAWINGS

The present invention will be understood more fully from the detailed description given hereinafter and from the accompanying drawings, which, however, should not be taken to be limitative to the invention, but are for explanation and understanding only.

In the drawings.

DESCRIPTION OF THE PREFERRED EMBODIMENT

Figure 1:
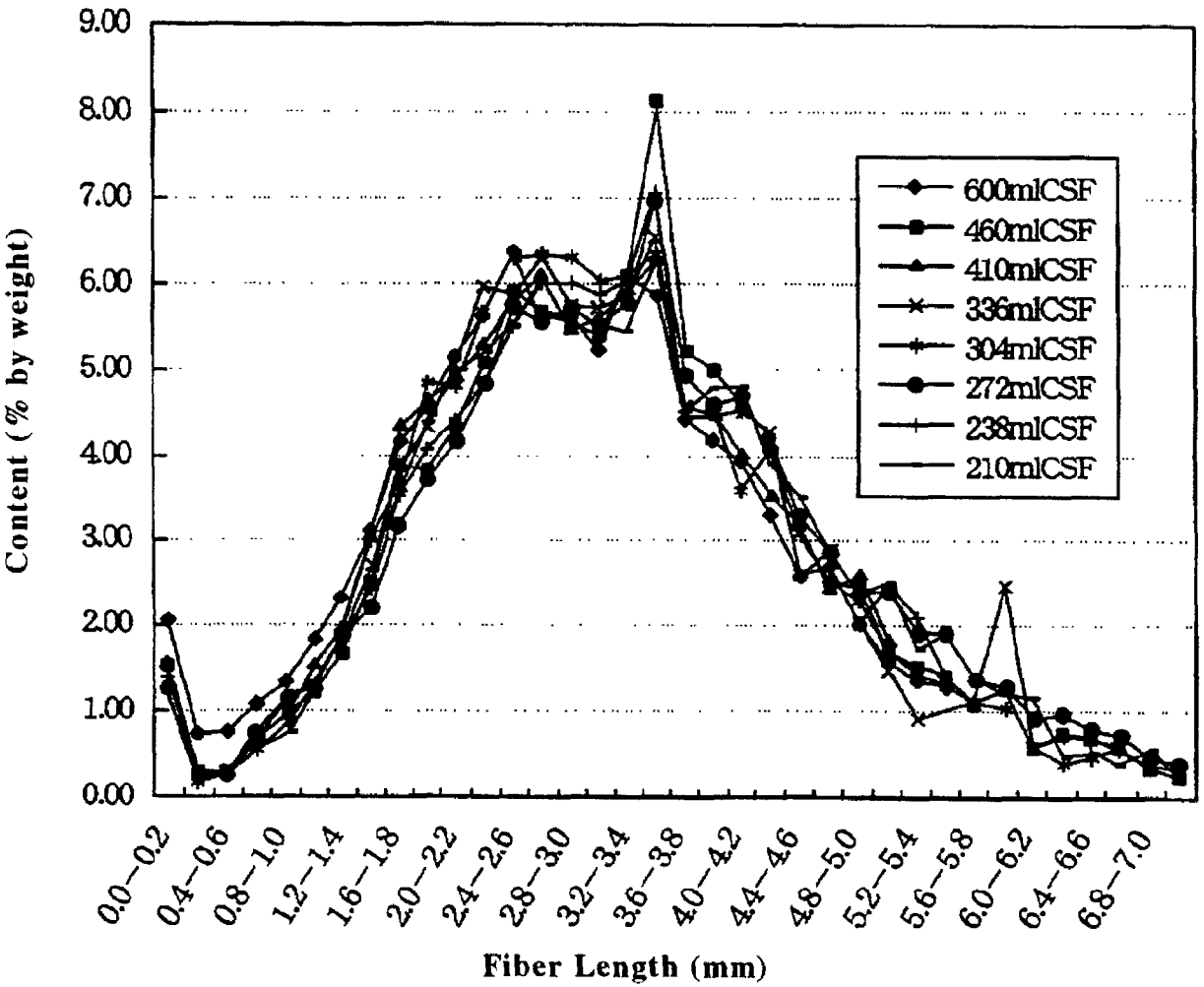
FIG. 1 is a graph showing fiber length distributions of fibrillated abaca for different Canadian Standard Freeness values.

The term "water disintegratable" as used herein means that when immersed in water, fibers forming a sheet are dispersed in a short period time so that the sheet breaks into multiple pieces.

The term "web" as used herein means a sheet-like fiber aggregate made by laying down and assembling fibers.

The term "bast/leaf fiber" as used herein means bast fiber or leaf fiber. The bast fiber refers to soft fiber such as flax (linen), ramie, hemp, jute, kenaf and China jute (Indian mallow heapskin). The leaf fiber refers to hard fiber such as abaca, sisal and New Zealand hemp.

The term "primary fiber" as used herein means fiber of the kind different from the bast/leaf fiber. The primary fiber has a fiber length of at most 10 mm. It should be noted that the water disintegratable sheet of the present invention does not contain any fiber which is longer than 10 mm.

The water disintegratable sheet according to the present invention comprises primary fibers and bast/leaf fibers. The primary fibers and the bast/leaf fibers are first formed into a fibrous web through a wet-laid or dry-laid process, subjected to a water-jet treatment for entangling fibers, and then dried to produce the water disintegratable sheet. With the bast/leaf fibers, the water disintegratable sheet can achieve a good balance of strength and water disintegratability. In addition, since the water disintegratable sheet has an uneven surface due to the water-jet treatment, bulk and softness can be enhanced.

The water disintegratable sheet according to the present invention can be used in a wide variety of applications. For instance, the water disintegratable sheet can be used as a topsheet or backsheet of an absorbent article such as sanitary napkin, vaginal discharge absorbing sheet (panty liner), incontinence pad and disposable diaper or a packaging sheet for packaging such an absorbent article. It is also possible to use the water disintegratable sheet as dry tissue paper. The water disintegratable sheet may also be used while being impregnated with water or a solution of chemicals. In this case, for instance, the water disintegratable sheet may be used as wet tissue paper for wiping a human body, or a cleaning sheet for cleaning a toilet or the like.

The bast/leaf fibers used for the water disintegratable sheet of the present invention should have a Canadian Standard Freeness (CSF) value of at most 600 milliliter (ml). The Canadian Standard Freeness value expresses the capacity of fibers to drain water, and also indicates the degree of beating of fibers, wherein low numbers indicate that the fibers are beaten more; high numbers indicate that the fibers are beaten less. When the bast/leaf fibers are so beaten as to obtain a Canadian Standard Freeness value of at most 600 ml, they are fibrillated to provide microfibers. Such microfibers can easily be entangled about other fibers through the water-jet treatment. Moreover, since the surface area of the bast/leaf fibers is increased due to formation of the microfibers, physical bonding strength due to hydrogen bond and/or Van der Waal's force can be increased. Thus, the beaten bast/leaf fibers substantially function as a binder to impart strength to the sheet. Should the bast/leaf fibers be unbeaten to have a Canadian Standard Freeness value of more than 600 ml, such bonding strength due to the microfibers can not be obtained.

Although there is no special reason to define the lower limit of the Canadian Standard Freeness value as long as the bast/leaf fibers are fibrillated, the bast/leaf fibers cannot be fibrillated by beating beyond a Canadian Standard Freeness value of about 100 ml. Preferably, the lower limit of the Canadian Standard Freeness value is 200 ml.

The beaten bast/leaf fibers should have a fiber length of at most 10 millimeter (mm), which refers to a maximum fiber length found in fiber length distribution thereof. If the fiber length is more than 10 mm, the bast/leaf fibers will be excessively entangled about each other and about the primary fibers when subjected to the water-jet treatment. When immersed in a large amount of water, therefore, the fibers are hardly dispersed, resulting in deterioration of water disintegratability. On the other hand, there is no special reason to define the lower limit of the fiber length of the beaten bast/leaf fibers, but about 1 mm is appropriate. Since bast/leaf fibers having a fiber length of less than 1 mm easily slip through a mesh screen during the wet-laid process, there is a possibility of decreasing the yield.

The water disintegratable sheet of the present invention preferably contains 2 to 30% by weight of the bast/leaf fibers, base on the total fiber weight of the water disintegratable sheet in a dry condition. If the bast/leaf fiber content is less than 2% by weight, the fibrillated bast/leaf fibers are less frequently entangled about each other and about the primary fibers, resulting in deterioration of sheet strength. If the bast/leaf fiber content is more than 30% by weight, the fibrillated bast/leaf fibers entangled about each other and about the primary fibers excessively increase the hydrogen bonding strength and/or van der Waal's force, resulting in deterioration of water disintegratability.

The term "entangle" as used herein means that fibers (which mainly refer to microfibers of bast/leaf fibers in the present invention) are wrapped and knotted about each other. The term "hydrogen bond" as used herein means a dipole-dipole force between molecules sharing one hydrogen atom, which is covalent bonded to one atom of at least one molecule having strong electronegativity. The term "Van der Waal's force" as used herein means an attraction force between molecules, which corresponds to internal pressure of Van der Waal's equation of state.

Examples of the bast/leaf fibers include flax (linen), ramie, hemp, jute, kenaf, China jute (Indian mallow heapskin), abaca, sisal and New Zealand hemp. In the present invention, a single kind of bast/leaf fibers may be employed alone or two or more kinds of bast/leaf fibers may be employed in combination. The bast/leaf fibers may or may not be bleached. It is, of course, possible to blend bleached bast/leaf fibers with unbleached bast/leaf fibers.

In the present invention, the bast/leaf fibers are beaten and fibrillated. The beaten bast/leaf fiber means that at least a portion of the fiber is split into microfibers. In the present invention, preferably performed is wet beating, in which the bast/leaf fibers can be split into the microfibers while maintaining their original fiber length. However, as long as the Canadian Standard Freeness value is equal to or less than 600 ml, free beating, in which the bast/leaf fibers will be chopped to decrease their fiber length, may also be performed.

For the bast/leaf fibers, at least one of abaca and sisal is preferably used. Since abaca and sisal are easy to beat and resulting microfibers are strong, they are suitable for use in the water disintegratable sheet of the present invention. Abaca and sisal have a fiber length in a range of 1.5 to 8.0 mm.

Figure 2:
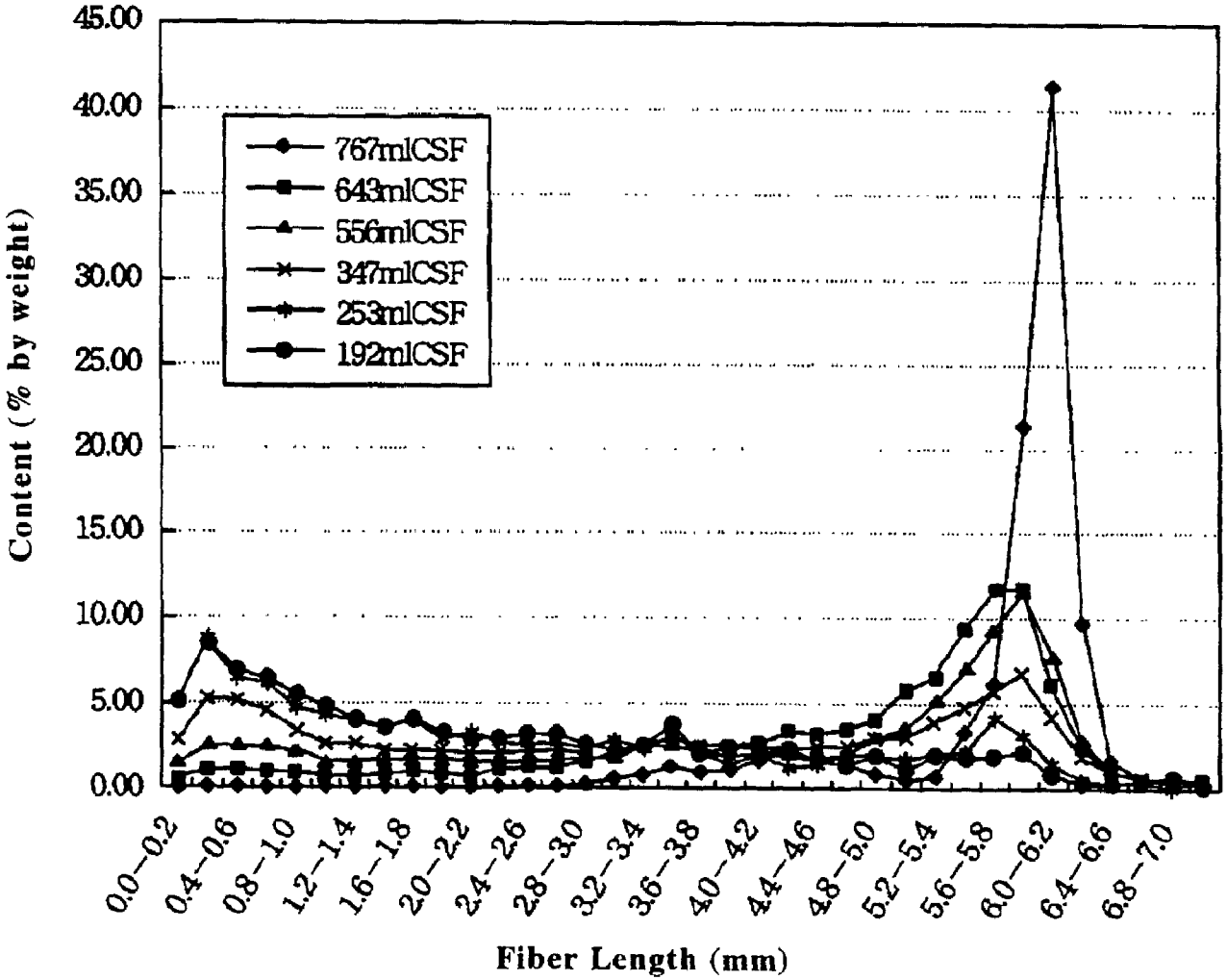
FIG. 2 is a graph showing fiber length distributions of fibrillated lyocell for different Canadian Standard Freeness values.

FIG. 1 shows fiber length distributions of beaten abaca (i.e., how fibers that differ in fiber length are distributed after beating abaca) for different Canadian Standard Freeness values. The fiber length distributions of beaten abaca are plotted with fiber lengths (mm) as abscissa against fiber contents at individual fiber lengths as ordinate. FIG. 2 is for comparison with abaca, and shows fiber length distributions of fibrillated lyocell for different Canadian Standard Freeness values. Here, the fibrillated lyocell was obtained by beating lyocell (purified cellulose fiber) with a refiner.

From FIG. 1, it is seen that the fiber length distribution of beaten abaca is less variable even if the Canadian Standard Freeness i.e., the degree of beating is varied. This means that abaca can easily be fibrillated by beating, and beaten abaca itself is so strong that the split microfibers are hardly chopped into small short pieces even if the beating is further progressed. Here, the individual fiber length distribution curves have their peaks near one half of the maximum fiber length, regardless of the Canadian Standard Freeness values.

When the bast/leaf fibers thus beaten are used, strong microfibers of various fiber lengths increase the fiber bonding strength, resulting in a sheet of high strength. Accordingly, the water disintegratable sheet can be provided with high strength even if the bast/leaf fiber content is much less than 30% by weight. By reducing the bast/leaf fiber content as much as possible, softness and improved hand can be provided to the sheet.

On the other hand, as seen from the peaks of fiber length distribution curves of FIG. 2, fibrillated lyocell has a definite main body portion (from which short microfibers protrude) when it is not beaten much, but as the lyocell is beaten more, the main body portion is shortened, and finally, it breaks into multiple short pieces.

From above, it is understood that the bast/leaf fiber is easy to beat as compared with lyocell (purified cellulose fiber) and is prevented from getting too short even if it is beaten much. Thus, since the bast/leaf fiber can easily be fibrillated by beating, it can be used as a low cost material.

Here, the bast/leaf fibers have a diameter of at most 32 μm, which is smaller than that (32 to 43 μm) of softwood pulp. Therefore, entanglement of the bast/leaf fibers can easily be achieved through the water-jet treatment, so that fiber entanglement can be assured even if the water-jet treatment is performed at low energy.

The primary fibers are preferably biodegradable. The term "biodegradable" as used herein means that fibers can be broken down in a living body or by bacteria. In this case, since not only the primary fibers but also the bast/leaf fibers are biodegradable, after the water disintegratable sheet is disposed of in a toilet or the like and disintegrated in water, the fibers dispersed in water can be biodegraded. Therefore, the functions of a septic tank and a sewage line will not be damaged, and deterioration of environment can be prevented.

Examples of the primary fiber being biodegradable include natural fiber (except for the bast/leaf fiber) such as pulp fiber, regenerated cellulose fiber and purified cellulose fiber. They may be used alone or in combination.

Examples of regenerated cellulose fiber include viscose rayon (rayon manufactured in viscose process) and cuprammonium rayon (cupra manufactured in cuprammonium process). On the other hand, purified cellulose fiber can be exemplified by lyocell which is manufactured in organic solvent spinning process. Such cellulose fibers may be fibrillated.

Examples of pulp fiber include wood pulp such as bleached softwood pulp, cotton linter pulp and mercerized pulp. They may be bleached or unbleached chemical pulp. It is, of course, possible to blend bleached chemical pulp with unbleached chemical pulp. Here, they may or may not be beaten, and may or may not be fibrillated. However, it is preferred that the pulp fibers are beaten to have a Canadian Standard Freeness value of 650 to 300 ml.

The primary fibers should also have a fiber length of at most 10 mm. Here, the pulp fibers have a fiber length of about 1 to 4 mm from the beginning. On the other hand, the fiber length of the regenerated cellulose fibers should be set at 10 mm or less. Should the fiber length be more than 10 mm, entanglement due to the water-jet treatment will be excessively promoted. Therefore, when the water disintegratable sheet is disposed of in a toilet or the like, such long fibers are hardly disentangled, resulting in deterioration of water disintegratability.

The primary fibers, particularly the regenerated cellulose fibers, preferably have a fineness of 0.6 to 11 dtex. If the fineness is less than 0.6 dtex, such thin fibers are hardly disentangled when immersed in water, resulting in deterioration of water disintegratability. If the fineness is more then 11 dtex, on the other hand, such thick fibers are hardly entangled during formation of the sheet, resulting in deterioration of wet and dry strengths of the water disintegratable sheet. In addition, such thick fibers make the sheet surface rough and deteriorate hand.

As has been described above, the water disintegratable sheet of the present invention contains 2 to 30% by weight of bast/leaf fibers. Therefore, the content of the primary fibers such as regenerated cellulose fibers, purified cellulose fibers and pulp fibers is 70 to 98% by weight.

The water disintegratable sheet of the present invention can be manufactured as follows.

At first, using a cylinder machine, "tan-ami" (short wire) machine, inclined wire machine or Fourdrinier machine, the bast/leaf fibers and the primary fibers suspended in water are fed onto a cylinder mold or the like, and collected thereon to form a fibrous web.

Then, the fibrous web is transferred onto a wire belt of a predetermined mesh size, and the fibrous web put on the wire belt is subjected to a water-jet treatment. In case of the inclined wire machine, the fibrous web formed on an inclined wire may be directly subjected to the water-jet treatment. With such water-jet treatment, the bast/leaf fibers are entangled about each other and about the primary fibers such as pulp and regenerated cellulose fibers.

After the water-jet treatment, the fibrous web is transferred onto a felt belt of high surface density, and conveyed while being wrapped around a dry drum for drying.

The term "water-jet treatment" as used herein refers to a process of mechanically entangling fibers by giving the fibrous web an impact with jets of water.

Figure 3:
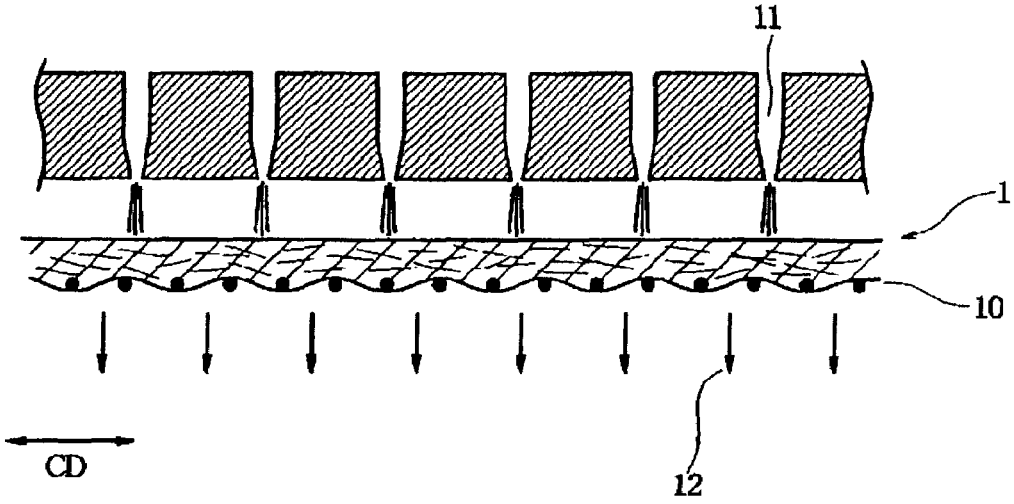
FIG. 3 illustrates a water-jet treatment.

FIG. 3 illustrates such water-jet treatment. As shown in FIG. 3, jets of water delivered through water-jet nozzles 11 are applied to a wet-laid web 1 composed of the bast/leaf fibers and the primary fibers, which is laid on a wire belt 10. At the same time, air 12 is sucked from the side opposite from the water-jet nozzles 11 to attract the web 1 on the belt 10. Thus, the fibers are entangled about each other with the water-jet energy.

In the water-jet treatment, it is preferred that processing conditions are adjusted to provide appropriate entanglement of the bast/leaf fibers and the primary fibers for achieving a good balance of the wet and dry strengths and the water disintegratability. To this end, it is preferred that the water-jet nozzles 11 have a nozzle hole diameter of 70 to 120 μm and are arranged at a pitch of 0.3 to 2.0 mm in CD. Here, the work done by jets of water delivered from the water-jet nozzles 11 in one water-jet treatment for one surface of the web 1 is preferably 0.05 to 0.5 $KW/m^2$. It is also preferred that the web is subjected to such water-jet treatment 1 to 6 times.

Here, the work done by jets of water is estimated from the following formula:

$$\{(1.63\times\text{jetting pressure}\times\text{jetting flow rate})/\text{processing speed}\}$$

With such water-jet treatment, the water disintegratable sheet can be provided with bulk and softness. Here, it is preferred that the mean density of the water disintegratable sheet is at most 0.30 $g/cm^3$ so as to provide sufficient bulk and softness. The mean density refers to a density measured after the water disintegratable sheet is allowed to stand for at least 30 minutes in an atmosphere having a temperature of 20±2° C. and a relative humidity of 65±2%.

The water disintegratable sheet preferably has a wet strength of at least 1.3 Newton (N) per 25 millimeter (mm) width, wherein the sheet is impregnated with water twice as heavy as the sheet weight. In a state where the sheet is dried, on the other hand, the water disintegratable sheet preferably has a dry strength of at least 5.0 N per 25 mm width.

Here, the wet and dry strengths refer to the square root of the product of the tensile strength (breaking strength) in MD and the tensile strength (breaking strength) in CD, wherein MD is a traveling direction of the web in the manufacturing process and CD is a direction perpendicular to MD.

When the water disintegratable sheet is disposed of in a flush toilet and immersed in a large amount of water in a flush toilet or a septic tank, the microfibers of the bast/leaf fibers can be disentangled and their hydrogen bonding force can be weakened. Moreover, the Van der Waal's force can be weakened by the flow of water. Therefore, the fibers can be dispersed in water.

The water disintegratable sheet preferably has a water disintegratability (water disintegration time) of at most 300 seconds. If the water disintegratability is equal to or less than 300 seconds, a used sheet disposed of in a toilet or the like can be effectively prevented from floating and remaining in a septic tank. More preferably, the water disintegratability is at most 100 seconds. If it is equal to or less than 100 seconds, the water disintegratable sheet disposed of in a flush toilet can be disintegrated to some extent before it reaches a septic tank.

The water disintegratable sheet preferably has a basis weight of 30 to 100 $g/m^2$. If the basis weight is less than 30 $g/m^2$, sufficient strength cannot be obtained, so that the sheet may easily break during use. If the basis weight is more than 100 $g/m^2$, it takes long time for the sheet to disintegrate in water, deteriorating water disintegratability. In addition, if the basis weight is beyond the limit, it is difficult to provide a web with a uniform fiber density, causing a variation in properties of a water disintegratable sheet formed of the web. However, in case where two or more water disintegratable sheets are to be stacked one on another for use, the basis weight of each water disintegratable sheet may be less than 30 $g/m^2$.

The water disintegratable sheet of the present invention may be used as a cleaning article such as wet tissue paper or wet wiper, which is to be supplied to consumers while being impregnated with a liquid. In this case, the water disintegratable sheet is impregnated with a liquid, which may be purified water, but may also contain humectant, anti-inflammatory agent, anti-bacterial agent, surfactant, alcohol, perfume and so on, according to demand. Here, it should be noted that since the water disintegratable sheet of the present invention is not impregnated with any inhibitor for inhibiting an organic substance binder from dissolving, the selection of chemicals to be added to the water disintegratable sheet depending on the purpose of the usage is not severely limited.

The water disintegratable sheet of the present invention may be of multi-layer structure. Such multi-layer structure can be obtained using any one of the foregoing paper machines. For example, a first web is wet-laid on the inclined wire or the like, and a second web is further wet-laid on the first web, to thereby form a multi-layer web. Such process may be repeated according to demand. Then, the multi-layer web is subjected to the water-jet treatment to form a single water disintegratable sheet. In this case, the blending ratio of the bast/leaf fibers and the primary fibers may vary for different webs.

As has been described hereinabove, the water disintegratable sheet of the present invention is not impregnated with either an organic substance binder such as pH reactive binder or a pH buffer solution containing an organic acid, but the bast/leaf fibers function as binder. Therefore, it never exerts a baneful influence upon the human body and environment. In addition, the properties of the water disintegratable sheet hardly change with passage of time, because the sheet does not contain the pH buffer solution of which the organic acid changes with passage of time. Moreover, since no organic substance binder is added, the water disintegratable sheet can be made soft to the touch, so that the sheet can be comfortably used.

EXAMPLES

Manufacturing Conditions of Examples and Comparative Examples

For preparing Examples and Comparative Examples, fibers were blended in ratios shown in Tables 1 to 5, and suspended in water to obtain fiber suspension. At this time, the fiber content was set at 0.02% by weight, based on the weight of the fiber suspension. Then, the fibers suspended in water were collected on a papermaking wire of 90 meshes, to thereby form a fibrous web having a length of 25 cm and a width of 25 cm.

Then, the web was put on a transfer conveyer together with the papermaking wire to travel at a speed of 30 m/min, and subjected to a water-jet treatment with three rows of water-jet nozzles having a nozzle hole diameter of 100 μm. In each row, the water-jet nozzles were arranged at a pitch of 0.5 mm in CD but in a staggered manner. At this time, the jetting pressure was set at 3.92 MPa and the work done by jets of water was set at 0.4 $KW/m^2$. Thereafter, the web thus treated with jets of water was dried by heating it for 90 seconds at 150° C. with a rotary drum type dryer to obtain Examples and Comparative Examples.

Used Fibers of Examples and Comparative Examples

As the bast/leaf fibers, used was abaca (Grade: JK). The abaca was suspended in water to have a fiber concentration of 0.6% by weight, and beaten with a mixer to have various Canadian Standard Freeness values, as shown in Tables 1 to 5. The fiber length distributions of the used abaca for respective Canadian Standard Freeness values were shown in FIG. 1.

As primary fibers, used were bleached softwood kraft pulp (NBKP), rayon and fibrillated lyocell.

The bleached softwood kraft pulp was beaten with a double disc refiner (of which two discs were rotated in opposite directions for beating) to have a Canadian Standard Freeness value of 600 ml.

The rayon (regenerated cellulose fiber) had a fineness of 1.1 dtex and a fiber length of 5 mm, which was manufactured by Daiwabo Rayon, Japan (trade name: Corona).

The fibrillated lyocell shown in Table 5 was prepared by beating lyocell (purified cellulose fiber having a fineness of 1.7 dtex and a fiber length of 6 mm) with a refiner to have a Canadian Standard Freeness value of 200 ml.

Method for Measuring Basis Weight, Thickness, and Density

Weights, thicknesses and densities of Examples and Comparative Examples were measured after standing for at least 30 minutes in an atmosphere having a temperature of 20±2° C. and a relative humidity of 65±2%.

Method for Measuring Canadian Standard Freeness

Canadian Standard Freeness was measured using a Canadian Standard Freeness tester composed of a filter cartridge, a measuring funnel and a table supporting the filter cartridge and the funnel. At the bottom of the filter cartridge, there was disposed a metal sieve plate, which was a circular plate having a diameter of 111.0±0.5 mm and a thickness of 0.5 mm and having 97 apertures per 1 $cm^2$. Each aperture had a diameter of 0.50 mm. The measuring funnel was made of metal, and had a diameter of 204 mm at its upper opening and an entire length of about 277 mm. This measuring funnel was provided with a bottom orifice and a side pipe.

The bottom orifice was provided at the bottom of the measuring funnel, and had a minimum diameter of 3.05±0.01 mm. The bottom orifice was designed to discharge 530±5 ml of water per minute, when water at 20.0±0.5° C. was supplied to the measuring funnel at a rate of 725±25 ml per minute. At this time, water that overflowed was intended to flow from the side pipe. The side pipe was a hallow tube having an internal diameter of about 13 mm and penetrating the side of the measuring funnel. The penetration length was adjustable. The volume of water between the upper portion of the bottom orifice and the overflow water-level was 23.5±0.2 ml.

The fibers were completely dispersed in water to a fiber concentration of 0.3% by weight, to thereby produce a sample liquid at 20.0±0.5° C. Then, 1000 ml of sample liquid was gently put in the filter cartridge to flow down to the measuring funnel, and an amount of water discharged from the side pipe was measured. The thus-measured value was rounded to an integral number, and the resulting numerical number was taken as a value of Canadian Standard Freeness, indicating the numerical number together with "CSF".

Method of Measuring Wet Strength

A test piece having a size of 25×150 mm, of which the short side was extended along CD and the long side was extended along MD, and a test piece having a size of 25×150 mm, of which the short side was extended along MD and the long side was extended along CD, were prepared, impregnated with a distilled water twice as heavy as each test piece, sealed in a plastic bag, and allowed to stand for 24 hours in an atmosphere having a temperature of 20±2° C. Then, the test pieces were taken out, and the short sides of each test piece were held with chucks of a tension tester. The initial chuck-to-chuck distance was set at 100 mm, and a tensile test was performed at a tension speed of 100 mm/minute. The maximum load (breaking load) measured by the tester was taken as a measured value. Such tensile test was performed both for the test piece having the long side along MD and the test piece having the long side along CD. $\sqrt{\{(\text{measured value in MD})\times(\text{measured value in CD})\}}$ was taken as the wet strength.

Method of Measuring Dry Strength

A test piece having a size of 25×150 mm, of which the short side was extended along CD and the long side was extended along MD, and a test piece having a size of 25×150 mm, of which the short side was extended along MD and the long side was extended along CD, were prepared, and the short sides of each test piece were held with chucks of a tension tester. The initial chuck-to-chuck distance was set at 100 mm, and a tensile test was performed at a tension speed of 100 mm/minute. The maximum load (breaking load) measured by the tester was taken as a measured value. Such tensile test was performed both for the test piece having the long side along MD and the test piece having the long side along CD. $\sqrt{\{(\text{measured value in MD})\times(\text{measured value in CD})\}}$ was taken as the dry strength.

Method for Measuring Water Disintegration Time

A disc rotor having a diameter of 35 mm and a thickness of 12 mm was put in a 300 ml beaker, which was filled with 300 ml of ion exchanged water and put on a magnetic stirrer. Then, the ion exchanged water was stirred by driving the rotor to rotate at a rate of 600 rpm. During stirring, a water disintegratable sheet cut into a size of 10 cm×10 cm was put in the ion exchanged water, thereby making the constituent fibers of the water disintegratable sheet disperse in the ion exchanged water. The time required for the fibers to disperse since the water disintegratable sheet was put in the ion exchanged water was measured by visual observation with a stop water. The time thus measured was taken as the water disintegration time.

Abaca Content

Table 1 shows relationships between the abaca content and the dry strength, wet strength and water disintegration time.

From Table 1, it is seen that the dry strength and wet strength can be increased by increasing the abaca content.

It should be noted that the water disintegratable sheet of the present invention preferably has a wet strength of at least 1.3 N/25 mm, since the sheet will easily break in actual use if the wet strength is less than 1.3 N/25 mm. From Table 1, it is seen that the abaca content should be 2.0% or more in order to obtain a wet strength of 1.3 N/25 mm or more.

It is also seen that the water disintegration time is increased as the abaca content is increased. Especially when the abaca content is more than 30% by weight, the water disintegration time is more than 300 seconds, resulting in deterioration of water disintegratability. Therefore, it is understood that the abaca content should be 30% by weight or less in order to provide the water disintegratable sheet with excellent water disintegratability (which means that water disintegration time is 300 seconds or less).

TABLE 1

| | | | Com. Ex. 1 | Ex. 1 | Ex. 2 | Ex. 3 | Ex. 4 | Ex. 5 | Com. Ex. 2 |
|---|---|---|---|---|---|---|---|---|---|
| Constituent Fiber and Content | NBKP (600 mlCSF) | wt. % | 85.0 | 83.0 | 82.0 | 80.0 | 70.0 | 55.0 | 50.0 |
| | Rayon (1.1 dtex, 5 mm) | wt. % | 15.0 | 15.0 | 15.0 | 15.0 | 15.0 | 15.0 | 15.0 |
| | Abaca (200 mlCSF) | wt. % | 0.0 | 2.0 | 3.0 | 5.0 | 15.0 | 30.0 | 35.0 |
| Basis Weight | | $g/m^2$ | 50.0 | 50.0 | 50.0 | 50.0 | 50.0 | 50.0 | 50.0 |
| Thickness | | mm | 0.41 | 0.40 | 0.39 | 0.39 | 0.39 | 0.40 | 0.40 |
| Density | | $g/cm^3$ | 0.122 | 0.125 | 0.128 | 0.128 | 0.128 | 0.125 | 0.125 |
| Dry Strength | | N/25 mm | 15.12 | 18.08 | 18.54 | 18.85 | 19.54 | 20.18 | 21.14 |
| Wet Strength | | N/25 mm | 0.98 | 1.30 | 1.59 | 1.72 | 2.11 | 2.24 | 2.37 |
| Water Disintegration Time | | second | 128 | 132 | 143 | 151 | 168 | 246 | More than 300 |

Canadian Standard Freeness of Abaca

Table 2 shows relationships between Canadian Standard Freeness (degree of beating) of abaca and the dry strength and wet strength.

From Table 2, it is seen that as the Canadian Standard Freeness value of abaca is decreased (as abaca is beaten more), the dry strength and wet strength are increased. It is also seen that abaca having a Canadian Standard Freeness value of 600 ml or less should be contained in order to obtain a wet strength of 1.3 N/25 mm or more.

TABLE 2

| | | | Com. Ex. 3 | Ex. 6 | Ex. 7 | Ex. 8 |
|---|---|---|---|---|---|---|
| Constituent Fiber and Content | NBKP (600 mlCSF) | wt. % | 80.0 | 80.0 | 80.0 | 80.0 |
| | Rayon (1.1 dtex, 5 mm) | wt. % | 15.0 | 15.0 | 15.0 | 15.0 |
| | Abaca (unbeaten) | wt. % | 5.0 | — | — | — |
| | Abaca (600 mlCSF) | wt. % | — | 5.0 | — | — |
| | Abaca (400 mlCSF) | wt. % | — | — | 5.0 | — |
| | Abaca (200 mlCSF) | wt. % | — | — | — | 5.0 |
| Basis Weight | | $g/m^2$ | 50.0 | 50.0 | 50.0 | 50.0 |
| Thickness | | mm | 0.38 | 0.40 | 0.41 | 0.39 |
| Density | | $g/cm^3$ | 0.132 | 0.125 | 0.122 | 0.128 |
| Dry Strength | | N/25 mm | 13.99 | 15.98 | 17.63 | 18.85 |
| Wet Strength | | N/25 mm | 1.12 | 1.42 | 1.62 | 1.72 |
| Water Disintegration Time | | second | 125 | 131 | 145 | 151 |

Fiber Length of Rayon

Table 3 shows relationships between the fiber length of rayon (regenerated cellulose fiber) and the dry strength, wet strength and water disintegration time.

From Table 3, it is seen that as the fiber length of rayon is increased, the dry strength and wet strength are increased.

Here, it is also seen that as the fiber length of rayon is increased, the water disintegration time is increased, and the fiber length of rayon should be 10 mm or less in order to obtain excellent water disintegratability (which means that water disintegration time is 300 seconds or less).

TABLE 3

| | | | Ex. 9 | Ex. 10 | Ex. 11 | Com. Ex. 4 |
|---|---|---|---|---|---|---|
| Constituent Fiber and Content | NBKP (600 mlCSF) | wt. % | 80.0 | 80.0 | 80.0 | 80.0 |
| | Abaca (200 mlCSF) | wt. % | 5.0 | 5.0 | 5.0 | 5.0 |
| | Rayon (1.1 dtex, 5 mm) | wt. % | 15.0 | — | — | — |
| | Rayon (1.1 dtex, 7 mm) | wt. % | — | 15.0 | — | — |
| | Rayon (1.1 dtex, 10 mm) | wt. % | — | — | 15.0 | — |
| | Rayon (1.1 dtex, 12 mm) | wt. % | — | — | — | 15.0 |
| Basis Weight | | $g/m^2$ | 50.0 | 50.0 | 50.0 | 50.0 |
| Thickness | | mm | 0.39 | 0.38 | 0.38 | 0.39 |
| Density | | $g/cm^3$ | 0.128 | 0.132 | 0.132 | 0.128 |
| Dry Strength | | N/25 mm | 18.85 | 19.28 | 20.11 | 21.10 |
| Wet Strength | | N/25 mm | 1.72 | 1.86 | 2.24 | 3.04 |
| Water Disintegration Time | | second | 151 | 172 | 283 | More than 300 |

Basis Weight of Water Disintegratable Sheet

Table 4 shows relationships between the basis weight of the water disintegratable sheet and the dry strength, wet strength and water disintegration time.

From Table 4, it is seen that the dry strength and wet strength can be increased by increasing the basis weight. The basis weight should be 30 $g/m^2$ or more in order to obtain a wet strength of 1.3 N/25 mm or more.

Here, it is also seen that as the basis weight is increased, the water disintegration time is increased. Especially when the basis weight is more than 100 $g/m^2$, the water disintegration time exceeds 300 seconds, resulting in deterioration of water disintegratability. The basis weight should be 100 $g/m^2$ or less in order to provide the water disintegratable sheet with excellent water disintegratability (which means that water disintegration time is 300 seconds or less).

TABLE 4

| | | | Com. Ex. 5 | Com. Ex. 6 | Ex. 12 | Ex. 13 | Ex. 14 | Ex. 15 | Ex. 16 | Com. Ex. 7 |
|---|---|---|---|---|---|---|---|---|---|---|
| Constituent | NBKP (600 mlCSF) | wt. % | 80.0 | 80.0 | 80.0 | 80.0 | 80.0 | 80.0 | 80.0 | 80.0 |
| Fiber and | Rayon (1.1 dtex, 5 mm) | wt. % | 15.0 | 15.0 | 15.0 | 15.0 | 15.0 | 15.0 | 15.0 | 15.0 |
| Content | Abaca (200 mlCSF) | wt. % | 5.0 | 5.0 | 5.0 | 5.0 | 5.0 | 5.0 | 5.0 | 5.0 |
| Basis Weight | | $g/m^2$ | 15.0 | 20.0 | 30.0 | 40.0 | 50.0 | 70.0 | 100.0 | 110.0 |
| Thickness | | mm | 0.23 | 0.25 | 0.30 | 0.36 | 0.39 | 0.43 | 0.52 | 0.57 |
| Density | | $g/cm^3$ | 0.065 | 0.080 | 0.100 | 0.111 | 0.128 | 0.163 | 0.192 | 0.193 |
| Dry Strength | | N/25 mm | 3.76 | 4.34 | 7.68 | 13.11 | 18.85 | 23.64 | 38.41 | 41.67 |
| Wet Strength | | N/25 mm | 0.34 | 0.47 | 1.34 | 1.51 | 1.72 | 2.85 | 3.34 | 3.96 |
| Water Disintegration Time | | second | 28 | 41 | 94 | 139 | 151 | 214 | 281 | More than 300 |

Comparison of Abaca Versus Fibrillated Lyocell with Respect to Dry Strength and Wet Strength Table 5 shows how the dry strength and wet strength vary between abaca and fibrillated lyocell having the same Canadian Standard Freeness value, while the abaca content is changed.

From Table 5, it is seen that when abaca is compared with fibrillated lyocell having the same Canadian Standard Freeness value, similar dry and wet strengths can be obtained even if the abaca content is smaller than the fibrillated lyocell content.

TABLE 5

| | | | Ex. 2 | Ex. 12 | Com. Ex. 8 |
|---|---|---|---|---|---|
| Constituent Fiber and Content | NBKP (600 mlCSF) | wt. % | 82.0 | 80.0 | 80.0 |
| | Rayon (1.1 dtex, 5 mm) | wt. % | 15.0 | 15.0 | 15.0 |
| | Abaca (200 mlCSF) | wt. % | 3.0 | 5.0 | — |
| | Fibrillated lyocell (200 mlCSF) | wt. % | — | — | 5.0 |
| Basis Weight | | $g/m^2$ | 50.0 | 50.0 | 50.0 |
| Thickness | | mm | 0.39 | 0.39 | 0.39 |
| Density | | $g/cm^3$ | 0.128 | 0.128 | 0.128 |
| Dry Strength | | N/25 mm | 18.54 | 18.85 | 17.44 |
| Wet Strength | | N/25 mm | 1.59 | 1.72 | 1.51 |
| Water Disintegration Time | | second | 143 | 151 | 141 |

Comparison of Abaca Versus Fibrillated Lyocell with Respect to Yield

The yields were measured for Example 17 and Comparative Example 9 which will be explained next.

(1) Example 17
Abaca (500 mlCSF): 80% by weight
NBKP: 20% by weight (2) Comparative Example 9
Fibrillated Lyocell (200 mlCSF): 80% by weight
NBKP: 20% by weight (3) Results (a) After Web Formation
Abaca-Containing Sheet: 98.6%
Fibrillated Lyocell-Containing Sheet: 96.3%

(b) After Water-Jet Treatment
Abaca-Containing Sheet: 94.4%
Fibrillated Lyocell-Containing Sheet: 89.2%

As set forth above, after the web formation, the yield of the abaca-containing sheet is higher than that of the fibrillated lyocell-containing sheet by 2.3%. After the water-jet treatment, on the other hand, the yield of the abaca-containing sheet is higher than that of the fibrillated lyocell-containing sheet by 5.2%.

Abaca can easily be kept long even after fibrillation, as compared with lyocell. Therefore, it can be prevented from slipping through the wire belt of the paper machine during the web formation and the water-jet treatment.

Especially when the web is subjected to the water-jet treatment, the fibers are pressed against the wire belt by jets of water, and therefore, it becomes much easier for the fibers to slip through the wire belt, than in the web formation. However, it is seen that the abaca-containing sheet is highly effective in improving the yield for such case.

As has been described hereinabove, the water disintegratable sheet of the present invention can achieve a good balance of strength and water disintegratability with the inexpensive bast/leaf fibers.

In addition, since the bast/leaf fibers can easily be kept long even after fibrillation, the yield can be improved as well as the energy necessary for the water-jet treatment can be reduced. Therefore, the production cost can be reduced.

Although the present invention has been described with respect to exemplary embodiments thereof, it should be understood by those skilled in the art that the foregoing and various other changes, omission and additions may be made therein and thereto, without departing from the spirit and scope of the present invention. Therefore, the present invention should not be understood as limited to the specific embodiments set out above but to include all possible embodiments which can be embodied within a scope encompassed and equivalent thereof with respect to the feature set out in the appended claims.

What is claimed is:

1. A water disintegratable sheet of which fibers are hydroentangled about each other, comprising:

at least one kind of primary fibers having a fiber length of at most 10 millimeter; and leaf fibers selected from the group consisting of abaca and sisal, and said leaf fibers fibrillated to have a Canadian Standard freeness value of at most 600 milliliter and a fiber length of 1.5 to 8 millimeter.

2. The water disintegratable sheet as set forth in claim 1, which contains 2 to 30% by weight of leaf fibers based on a total fiber weight of the water disintegratable sheet.

3. The water disintegratable sheet as set forth in claim 1, wherein the primary fibers are biodegradable fibers.

4. The water disintegratable sheet as set forth in claim 3, wherein the biodegradable fibers are at least one of pulp fibers and regenerated cellulose fibers.

5. The water disintegratable sheet as set forth in claim 1, which has a dry strength of at least 5.0 Newton per 25 millimeter width.

6. The water disintegratable sheet as set forth in claim 1, which has a wet strength of at least 1.3 Newton per 25 millimeter width.

7. The water disintegratable sheet as set forth in claim 1, which has a basis weight of 30 to 100 $g/m^2$.

8. The water disintegratable sheet as set forth in claim 1, which has a water disintegratability of at most 300 seconds.

* * * * *